US007720200B2

(12) United States Patent
Steinlage et al.

(10) Patent No.: US 7,720,200 B2
(45) Date of Patent: May 18, 2010

(54) APPARATUS FOR X-RAY GENERATION AND METHOD OF MAKING SAME

(75) Inventors: Gregory Alan Steinlage, Hartland, WI (US); Michael Hebert, Muskego, WI (US); Michael Lathrop, Big Bend, WI (US); Kirk A. Rogers, Chagrin Falls, OH (US); Thomas C. Tiearney, Jr., Waukesha, WI (US)

(73) Assignee: General Electric Company, Schenectady, NY (US)

( * ) Notice: Subject to any disclaimer, the term of this patent is extended or adjusted under 35 U.S.C. 154(b) by 21 days.

(21) Appl. No.: 11/865,928

(22) Filed: Oct. 2, 2007

(65) Prior Publication Data

US 2009/0086919 A1 Apr. 2, 2009

(51) Int. Cl.
*H01J 35/10* (2006.01)

(52) U.S. Cl. ..... 378/144; 378/128; 378/129

(58) Field of Classification Search ..... 378/127–129, 378/143, 144
See application file for complete search history.

(56) References Cited

U.S. PATENT DOCUMENTS 3,875,444 A * 4/1975 Magendans et al. ..... 378/144
3,993,923 A * 11/1976 Magendans et al. ..... 378/144
4,090,103 A * 5/1978 Machenschalk et al. ..... 378/144
4,195,247 A * 3/1980 Hirsch ..... 378/144
4,224,273 A * 9/1980 Magendans et al. ..... 264/259
4,271,372 A * 6/1981 Geldner et al. ..... 378/144
4,299,860 A * 11/1981 Schaefer et al. ..... 427/556
4,331,902 A * 5/1982 Magendans et al. ..... 378/144
4,516,255 A * 5/1985 Petter et al. ..... 378/143
4,534,993 A * 8/1985 Magendans et al. ..... 427/455
4,613,386 A * 9/1986 Yates et al. ..... 148/241
4,641,334 A * 2/1987 Devine, Jr. ..... 378/144
5,138,645 A * 8/1992 Penato et al. ..... 378/144
5,204,891 A * 4/1993 Woodruff et al. ..... 378/143
6,487,275 B1 * 11/2002 Baba et al. ..... 378/144
6,504,127 B1 1/2003 McGregor et al.
7,286,893 B1 * 10/2007 Mazumder ..... 700/145
7,505,565 B2 * 3/2009 Tiearney et al. ..... 378/143
2006/0049153 A1 * 3/2006 Cahoon et al. ..... 219/121.63

FOREIGN PATENT DOCUMENTS

WO 2009019645 A2 2/2009

* cited by examiner

*Primary Examiner*—Edward J Glick
*Assistant Examiner*—Thomas R Artman
(74) *Attorney, Agent, or Firm*—Ziolkowski Patent Solutions Group, SC

(57) ABSTRACT

A composite target for generating x-rays includes a target substrate and at least one material applied to the target substrate with a laser beam.

21 Claims, 5 Drawing Sheets

APPARATUS FOR X-RAY GENERATION AND METHOD OF MAKING SAME

BACKGROUND OF THE INVENTION

The present invention relates generally to x-ray tubes and, more particularly, to an apparatus for x-ray generation and a method of fabrication.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes include a rotating anode structure for the purpose of distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across a cathode-to-anode vacuum gap and produces x-rays upon impact with the anode. Because of the high temperatures generated when the electron beam strikes the target, it is necessary to rotate the anode assembly at high rotational speed.

Newer generation x-ray tubes have increasing demands for providing higher peak power. Higher peak power, though, results in higher peak temperatures occurring in the target assembly, particularly at the target "track," or the point of impact on the target. Thus, for increased peak power applied, there are life and reliability issues with respect to the target. Such effects may be countered to an extent by, for instance, spinning the target faster. However, doing so has implications to reliability and performance of other components within the x-ray tube. As a result there is greater emphasis in finding material and fabrication solutions for improved performance and higher reliability of target structures within an x-ray tube. Furthermore, there is greater emphasis on repair and reuse of x-ray tube targets and other x-ray tube components. Thus there is a need to salvage what might otherwise be unrecoverable x-ray tube targets.

Therefore, it would be desirable to have a method and apparatus to improve target track fabrication and repair of an x-ray tube target.

BRIEF DESCRIPTION OF THE INVENTION

The present invention provides a method and apparatus that overcome the aforementioned drawbacks. The x-ray target track is fabricated or repaired using a laser beam to heat the substrate of the target while applying a material to the substrate in order to fuse the materials together. The process may be performed multiple times to form layered or graded structures or interfaces, and it may be performed to fabricate complex geometries of track material on the surface of the target.

According to one aspect of the present invention, a composite target for generating x-rays includes a target substrate and at least one material applied to the target substrate with a laser beam.

In accordance with another aspect of the invention, a method of fabricating an x-ray target assembly includes forming an x-ray target substrate, directing at least one laser beam toward a surface of the x-ray target substrate to create a first heated area, and applying a first layer of at least one powder to the first heated area.

Yet another aspect of the present invention includes an imaging system having an x-ray detector and an x-ray emission source. The x-ray emission source includes an anode having a target base material and a track comprising at least one layer of a track material applied to the target base material using a laser process.

Still another aspect of the present invention includes a method of repairing a target for an x-ray tube. The method includes applying at least one laser beam to a surface of the x-ray tube target to create a heated area and applying a powder material to the heated area.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
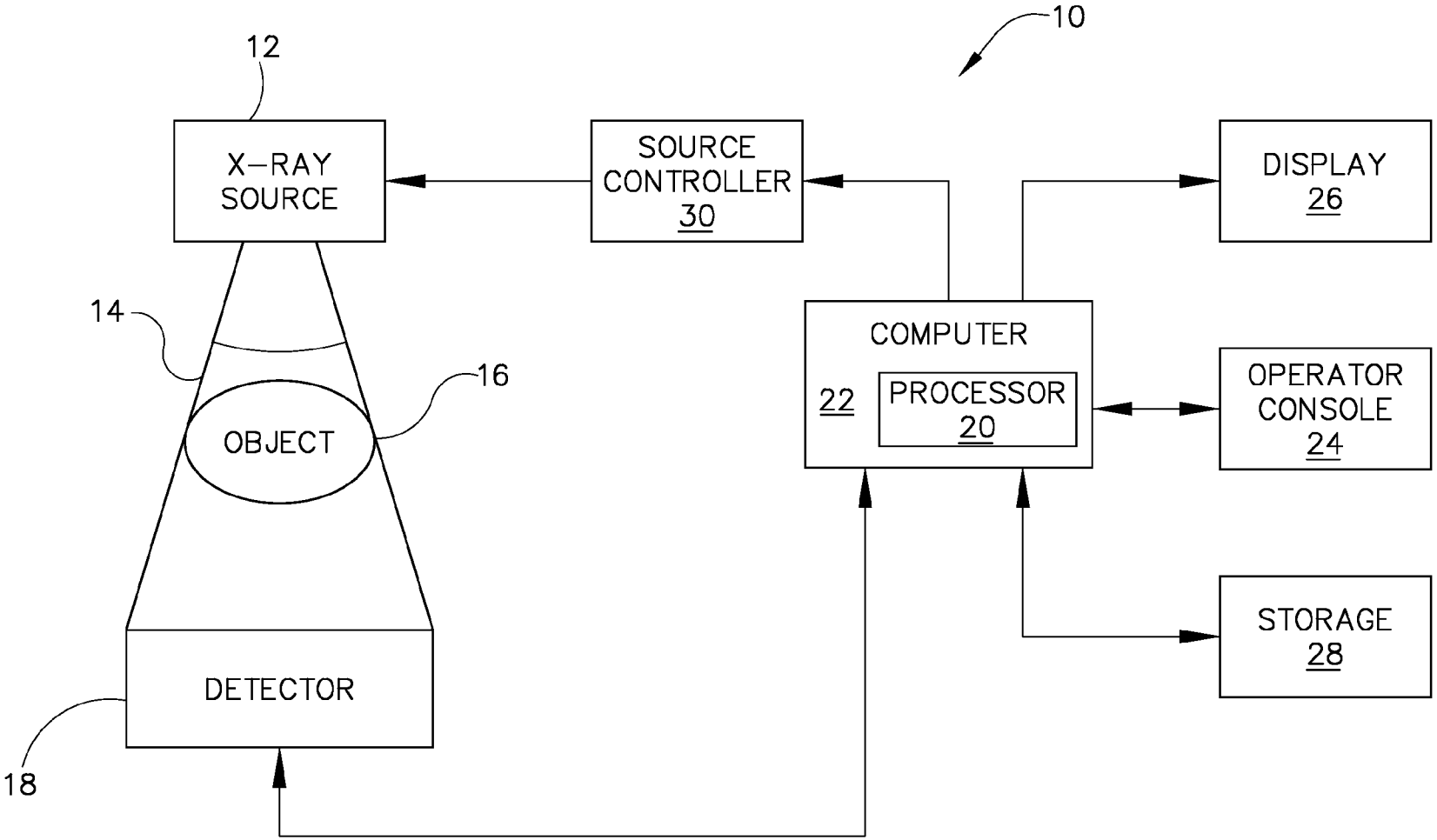
FIG. 1 is a block diagram of an imaging system that can benefit from incorporation of an embodiment of the present invention.

FIG. 1 is a block diagram of an embodiment of an imaging system 10 designed both to acquire original image data and to process the image data for display and/or analysis in accordance with the present invention. It will be appreciated by those skilled in the art that the present invention is applicable to numerous medical imaging systems implementing an x-ray tube, such as a CT system, an x-ray system, a vascular system, and a mammography system. Other imaging systems such as computed tomography systems and digital radiography systems, which acquire image three dimensional data for a volume, also benefit from the present invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Moreover, the present invention will be described with respect to use in an x-ray tube. However, one skilled in the art will further appreciate that the present invention is equally applicable for other systems that require operation of a target used for the production of x-rays wherein high peak temperatures are driven by peak power requirements.

Figure 2:
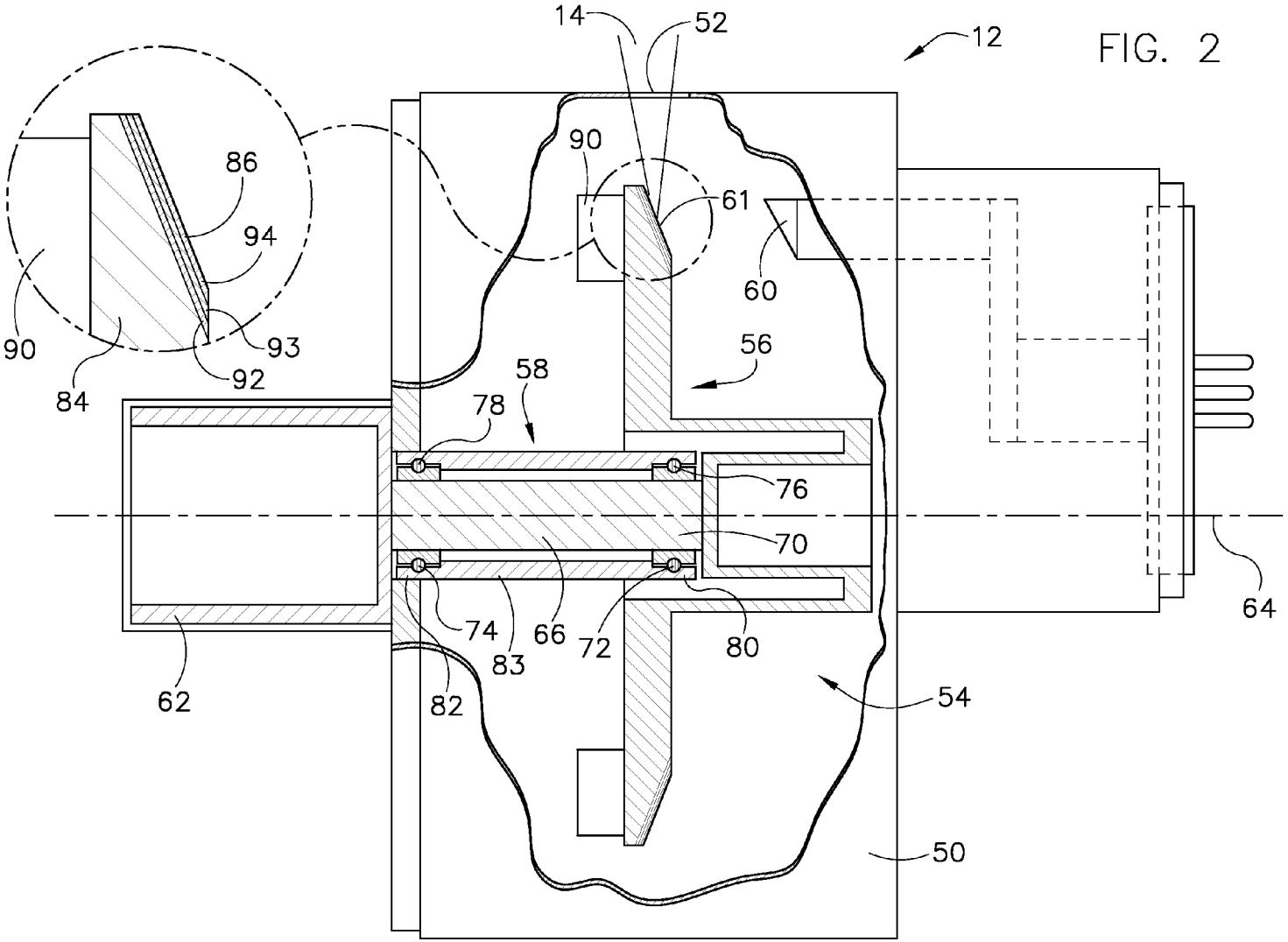
FIG. 2 is a cross-sectional view of an x-ray tube useable with the system illustrated in FIG. 1 according to an embodiment of the present invention.

FIG. 2 illustrates a cross-sectional view of an x-ray tube 12 that can benefit from incorporation of an embodiment of the present invention. The x-ray tube 12 includes a casing 50 having a radiation emission passage 52 formed therein. The casing 50 encloses a vacuum 54 and houses an anode 56, a bearing assembly 58, a cathode 60, and a rotor 62. X-rays 14 are produced when high-speed electrons are suddenly decelerated when directed from the cathode 60 to the anode 56 via a potential difference therebetween of, for example, 60 thousand volts or more in the case of CT applications. The electrons impact a material layer or target track 86 at focal point 61 and x-rays 14 emit therefrom. The point of impact is typically referred to in the industry as the focal spot, which forms a circular region or track on the surface of the target track 86, and is visually evident on the target surface after operation of the x-ray tube 12. According to an embodiment of the present invention, target track 86 may include a plurality of layers 92, 93, 94 applied according to the disclosed process. The x-rays 15 emit through the radiation emission passage 52 toward a detector array, such as detector 18 of FIG. 1. To avoid overheating the anode 56 from the electrons, the anode 56 is rotated at a high rate of speed about a centerline 64 at, for example, 90-250 Hz.

The bearing assembly 58 includes a center shaft 66 attached to the rotor 62 at first end 68 and attached to the anode 56 at second end 70. A front inner race 72 and a rear inner race 74 rollingly engage a plurality of front balls 76 and a plurality of rear balls 78, respectively. Bearing assembly 58 also includes a front outer race 80 and a rear outer race 82 configured to rollingly engage and position, respectively, the plurality of front balls 76 and the plurality of rear balls 78. Bearing assembly 58 includes a stem 83 which is supported by the x-ray tube 12. A stator (not shown) is positioned radially external to and drives the rotor 62, which rotationally drives anode 56. As shown in FIG. 2, a heat storage medium 90, such as graphite, may be used to sink and/or dissipate heat built-up near the target track 63.

Referring still to FIG. 2, the anode 56 includes a target substrate 84, having target track 86 attached thereto according to an embodiment of the present invention. The target track 86 typically includes tungsten or an alloy of tungsten such as tungsten with rhenium ranging from 3-10%. The target substrate 84 typically includes molybdenum or an alloy of molybdenum such as TZM (Titanium, Zirconium, and Molybdenum).

Figure 3:
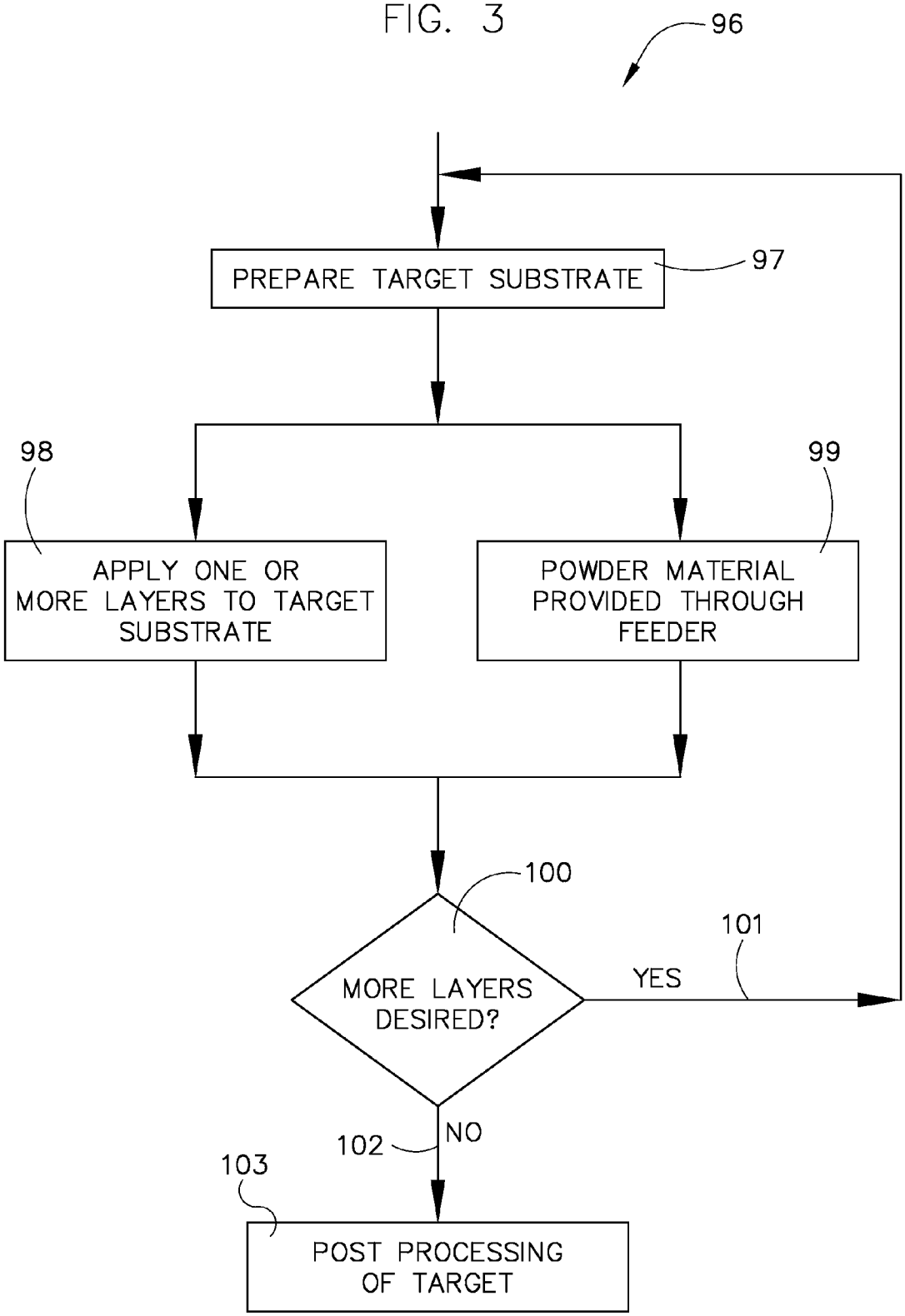
FIG. 3 is a flowchart of a target fabrication or repair process according to an embodiment of the present invention.

According to embodiments of the present invention, the target track 86 may be applied to a base substrate such as target substrate 84 by a laser consolidation process 96 as illustrated in FIG. 3. In process 96, the target substrate 84 is prepared at step 97, which may include, but is not limited to: 1) heat treatment such as may be required for densification, stress relief, and the like; 2) surface preparation which may include cleaning, fusing, roughening, and the like; and 3) cleaning and mounting of the target substrate 84 in a fixture. At step 98, one or more beams of laser energy are arranged to impinge an area of the target substrate 84, thus heating a region of the target substrate 84. In one embodiment of the present invention, the heating of the target substrate 84 is adequate to melt a region of the target substrate 84. At step 99, powdered material is typically simultaneously supplied through a feeder to the heated region of the target substrate 84 at a rate that is controlled so that the added material melts and bonds with the underlying material of the target substrate 84. At step 100, after application of a layer, it is determined whether another layer is desired and, if so, the process at 101 repeats steps 97, 98 and 99, which may include changing the material of the powder to be applied as described above. If no further layers are desired, then at step 102, the process calls for moving to a post-processing step at 103, during which the target may be removed, cleaned, and otherwise prepared for further assembly with anode 56. The target track 86 typically may range from thicknesses ranging from tens of microns in thickness to hundreds of microns in thickness.

Figure 4:
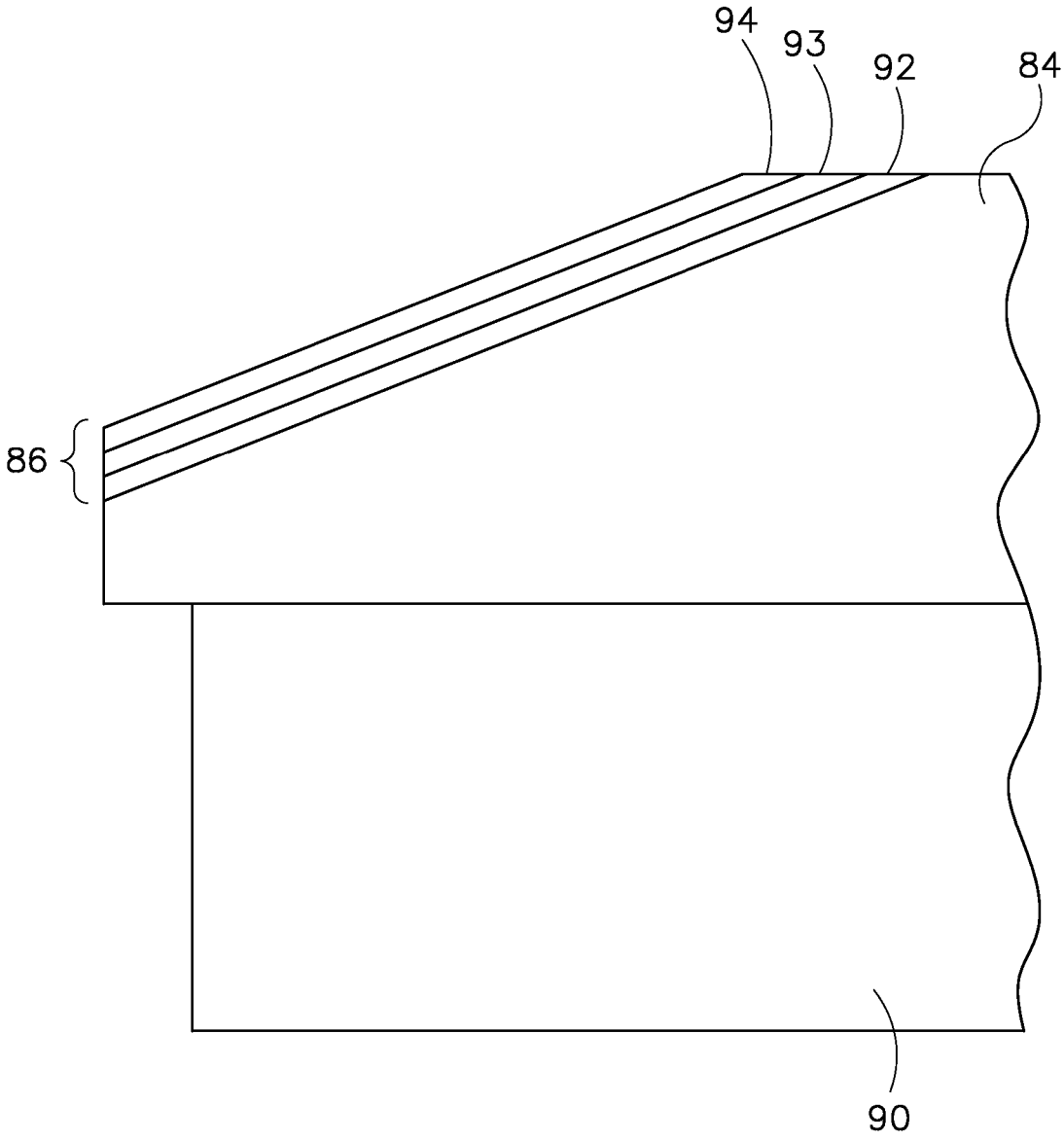
FIG. 4 is a cross-sectional view of an x-ray tube target according to an embodiment of the present invention.

Referring now to FIG. 4, a multi-layer target track 86 may be applied to the target substrate 84 according to an embodiment of the present invention employing process 96 as described in FIG. 3. A first layer 92 is applied to the target substrate 84 as described above. Then, each succeeding layer 93, 94 is applied on preceding layers 92, 93, respectively, one at a time as described above such that layers 92, 93 serve as base substrates for layers 93, 94, respectively. In one embodiment, layer 92 is tungsten, layer 93 is rhenium, and layer 94 is an alloy of tungsten and rhenium. It is recognized that target track 86 may include more or less than three layers, or that the layers 92-94 may include combinations and alloys thereof. It is further recognized that the layers 92-94 may be applied with powder that contains a mix of alloying components. As an example, layer 92, for instance, may be applied using a powder having 5% rhenium and in a mixture. As such, layer 92 may be applied as an alloy that will form upon impingement with the heated region on the target substrate 98.

Process 96 may be altered from that described above, according to embodiments of the present invention, to use other materials such as rhodium and its alloys, alloys of tungsten, alloys of molybdenum, alloys of tantalum, alloys of rhenium, and other refractory and non-refractory metals. For instance, one skilled in the art will recognize that specific properties of the target track 86 may be affected according to the thicknesses of individual layers 92-94 applied to the substrate 84, how many layers 92-94 are applied overall, and the selection of powders and their mixtures during process 96 at step 99. Material properties that may be affected by appropriate selection of process 96 parameters include but are not limited to surface emissivity, coefficient of thermal expansion (CTE), thermal conductivity, fatigue strength and crack resistance, and elastic modulus. For instance, one skilled in the art will recognize that tantalum, having a relatively high CTE and a relatively low elastic modulus as compared generally to other metals, may be applied as one or more layers to affect the overall CTE and elastic modulus of target track 86. Furthermore, such materials may not be limited to use as x-ray emission materials, but may also be applied according to an embodiment of this invention as braze materials including, but not limited to, zirconium, titanium, vanadium, and platinum. Such materials may also be used for surface emissivity enhancement. Additionally, one skilled in the art would recognize that layers of materials 92, 94, 96 may be applied to the target substrate 84 to protrude or extend from a surface of the substrate 84.

One skilled in the art will further recognize that many combinations of materials may be applied in powder form at step 99 of process 96. For instance, a gradient of materials may be applied to fabricate target track 86 by applying, for instance, first layer 92 having 75% tungsten and 25% rhenium, and second layer 93 having 90% tungsten and 10% rhenium. As such, target track 86 may be formed having a gradient, or varying concentration of elements, therein, by appropriately selecting and varying the alloying elements from one layer to the next.

Materials applied using the process described herein need not be limited to those described above. One skilled in the art will recognize that, in addition to metals, oxides including oxides of lanthanum, yttrium, aluminum, and zirconium may be applied according to embodiments of the present invention. Furthermore, carbides, such as carbides of titanium, hafnium, and boron may be applied as well.

The process 96 disclosed herein can likewise be performed on pre-formed target cap materials. Accordingly, the materials deposited thereon may include wrought materials as well. Additionally, the process described herein allows the deposition of graded structures of track material, as well as complex geometries.

The process described herein need not be limited to new x-ray target fabrication, but may be applicable to repair and reuse of targets as well. Accordingly, targets may be salvageable by disassembling them from the x-ray tube and reprocessing them by using the method described herein. Targets having track material 86 damaged after use may be recovered by having the target track 86 replaced or repaired. Additionally, new targets fabricated with defects that may include but are not limited to pits, cracks, and voids may be recoverable via this method as well. As such, target preparation step 97 of process 96 may include but is not limited to target disassembly from an anode 56, and machining or grinding of the target track 86 to expose the substrate 84 prior to applying a first layer 92.

High-density coatings may be fabricated with this method as well. Density problems inherent in, for instance, a plasma-spray process may be mitigated by use of this process to apply high-density coatings to increase mechanical properties such as spallation and fatigue resistance. For some materials and material combinations, post-processing including but not limited to hot isostatic pressing (HIP) processing may be required.

Figure 5:
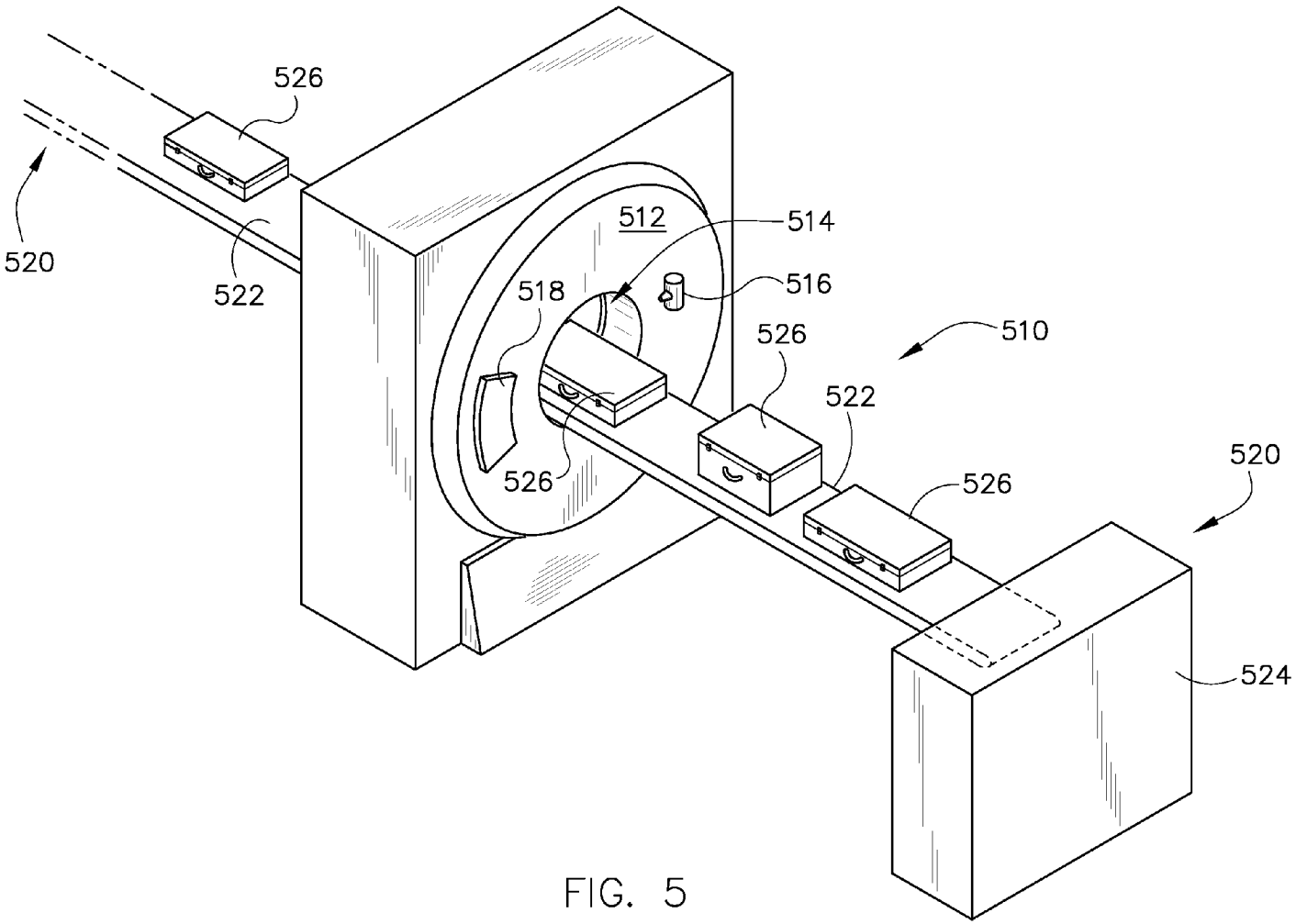
FIG. 5 is a pictorial view of a CT system for use with a non-invasive package inspection system.

Referring now to FIG. 5, package/baggage inspection system 510 includes a rotatable gantry 512 having an opening 514 therein through which packages or pieces of baggage may pass. The rotatable gantry 512 houses an x-ray energy source 516 as well as a detector assembly 518 having scintillator arrays comprised of scintillator cells similar to that shown in FIG. 4 or 5. A conveyor system 520 is also provided and includes a conveyor belt 522 supported by structure 524 to automatically and continuously pass packages or baggage pieces 526 through opening 514 to be scanned. Objects 526 are fed through opening 514 by conveyor belt 522, imaging data is then acquired, and the conveyor belt 522 removes the packages 526 from opening 514 in a controlled and continuous manner. As a result, postal inspectors, baggage handlers, and other security personnel may non-invasively inspect the contents of packages 526 for explosives, knives, guns, contraband, etc.

According to one embodiment of the present invention, a composite target for generating x-rays includes a target for generating x-rays and includes a target substrate and at least one material applied to the target substrate with a laser beam.

In accordance with another embodiment of the invention, a method of fabricating an x-ray target assembly includes forming an x-ray target substrate, directing at least one laser beam toward a surface of the x-ray target substrate to create a first heated area, and applying a first layer of at least one powder to the first heated area.

Yet another embodiment of the present invention includes an imaging system having an x-ray detector and an x-ray emission source. The x-ray emission source includes an anode having a target base material and a track comprising at least one layer of a track material applied to the target base material using a laser process.

Still another embodiment of the present invention includes a method of repairing a target for an x-ray tube. The method includes applying at least one laser beam to a surface of the x-ray tube target to create a heated area and applying a powder material to the heated area.

The present invention has been described in terms of the preferred embodiment, and it is recognized that equivalents, alternatives, and modifications, aside from those expressly stated, are possible and within the scope of the appending claims.

What is claimed is:

1. A composite target for generating x-rays thereon comprising:

a target substrate; and a track adhered to the target substrate, the track comprising a first layer adhered to the target substrate and a second layer adhered to the first layer, wherein the first and second layers are comprised of different amounts of at least two different materials, and wherein one of the at least two materials comprises tantalum wherein, one of the at least two different materials comprises tungsten and another of the at least two different materials comprises rhenium;

a percentage of tungsten in the second layer is greater than a percentage of tungsten in the first layer; and a percentage of rhenium in the first layer is greater than a percentage of rhenium in the second layer.

2. The target of claim 1 wherein the first and second layers of the track form a graded composition, the target substrate is pre-formed, and the track is deposited to a surface of the pre-formed target substrate.

3. The target of claim 1 wherein the track includes a powder fused to the target substrate.

4. The target of claim 1 wherein the track comprises at least one of, rhodium, and molybdenum, and alloys thereof and the target substrate comprises at least one of molybdenum and an alloy of molybdenum.

5. The target of claim 1 wherein the track comprises one of a braze material and a material applied to a surface of the target to enhance emissivity.

6. The target of claim 5 wherein the braze material comprises at least one of zirconium, titanium, vanadium, and platinum.

7. The target of claim 1 wherein the track comprises at least one of an oxide and a carbide.

8. The target of claim 7 wherein the oxide is one of lanthanum, yttrium, aluminum, and zirconium and the carbide is one of titanium, hafnium, and boron.

9. A method of fabricating an x-ray target comprising:
forming an x-ray target substrate;
directing at least one laser beam toward a surface of the x-ray target substrate to create a first heated area;
simultaneously applying a first powder to the first heated area while the at least one laser beam is being directed toward the surface of the x-ray target substrate such that the first powder intentionally melts and bonds with the x-ray target substrate to form a first layer;
directing at least one laser beam to the first layer to create a second heated area; and
simultaneously applying a second powder to the second heated area such that the second powder intentionally melts and bonds with the first layer to form a second layer;
wherein:
the first powder is comprised of at least two different materials;
the second powder is comprised of different amounts of the at least two different materials used to form the first layer;
one of the at least two different materials is tungsten and another of the at least two different materials is rhenium;
a percentage of tungsten in the second powder is greater than a percentage of tungsten in the first powder; and
a percentage of rhenium in the first powder is greater than a percentage of rhenium in the second layer.

10. The method of claim 9 wherein the first powder comprises at least one of rhenium, rhodium, tungsten, molybdenum, and tantalum, and alloys thereof.

11. The method of claim 9 wherein at least one of the first and second heated areas are heated above a melt temperature of the substrate or the first layer.

12. An imaging system comprising:
an x-ray detector; and
an x-ray emission source having an anode comprising:
a target base material; and
a track comprising at least a first layer applied to the target base material, and a second layer applied to the first layer;
wherein:
the first layer includes a first material and a second material;
the second layer includes the first material and the second material;
a percentage of the first material in the first layer is greater than a percentage of the first material in the second layer;
a percentage of the second material in the first layer is less than a percentage of the second material in the second layer;
one of the first and second materials is tungsten and the other of the first and second materials is rhenium; and
a percentage of tungsten in the first layer is less than a percentage of tungsten in the second layer.

13. The imaging system of claim 12 wherein the target base material comprises molybdenum.

14. The imaging system of claim 12 wherein the first and second materials are composed of one of rhenium, rhodium, tungsten, molybdenum, and tantalum and alloys thereof.

15. A method of repairing a target for an x-ray tube comprising:
salvaging and reprocessing an x-ray tube target comprising:
disassembling the x-ray tube target from the x-ray tube;
applying at least one laser beam to a surface of the x-ray tube target to create a first heated area;
applying a powder material to the first heated area to cause the powder material to melt and form a first layer of melted material on the surface of the x-ray tube target;
applying the at least one laser beam to the first layer to create a second heated area; and
applying the powder material to the second heated area;
wherein the powder material applied to the first heated area has a concentration of first and second elements that is different from a concentration of the first and second elements applied to the second heated area.

16. The method of claim 15 wherein the powder material comprises at least one of rhenium, rhodium, tungsten, molybdenum, tantalum, and alloys thereof.

17. The method of claim 15 wherein:
one of the first and second elements is tungsten and the other of the first and second elements is rhenium;
a percentage of tungsten in the powder applied to the second heated area is greater than a percentage of tungsten in the first layer; and
a percentage of rhenium in the first layer is greater than a percentage of rhenium in the powder applied to the second heated area.

18. A method of forming a target track for an x-ray tube comprising:
repairing a defect on a target track of a target comprising:
disassembling the target from an x-ray tube;
melting a portion of the target via two or more laser beams applied to a spot;
applying a first powder to the spot having a first concentration of first and second elements; and
applying a second powder to the spot having a second concentration of the first and second elements that is different from the first concentration of the first and second elements.

19. The method of claim 18 wherein the first element is tungsten and the second element is rhenium.

20. The method of claim 18 wherein:
one of the first and second elements is tungsten and the other of the first and second elements is rhenium; and
a percentage of tungsten in the first powder is less than a percentage of tungsten in the second powder.

21. A method of fabricating an x-ray target comprising:
forming an x-ray target substrate;
directing at least one laser beam toward a surface of the x-ray target substrate to create a first heated area;
simultaneously applying a first powder to the first heated area while the at least one laser beam is being directed toward the surface of the x-ray target substrate such that the first powder intentionally melts and bonds with the x-ray target substrate to form a first layer;
directing at least one laser beam to the first layer to create a second heated area; and simultaneously applying a second powder to the second heated area such that the second powder intentionally melts and bonds with the first layer to form a second layer;

wherein:

the first powder is comprised of at least two different materials;

the second powder is comprised of different amounts of the at least two different materials used to form the first layer;

one of the at least two different materials is tungsten and another of the at least two different materials is rhenium; and a percentage of tungsten in the first layer is less than a percentage of tungsten in the second layer.

* * * * *